US006590542B1

(12) United States Patent
Briggs

(10) Patent No.: US 6,590,542 B1
(45) Date of Patent: Jul. 8, 2003

(54) DOUBLE LOOP ANTENNA

(76) Inventor: James B. Briggs, 936 Big Briar Way, La Canada, CA (US) 91011

( * ) Notice: Subject to any disclaimer, the term of this patent is extended or adjusted under 35 U.S.C. 154(b) by 0 days.

(21) Appl. No.: 10/022,764

(22) Filed: Dec. 17, 2001

(51) Int. Cl.[7] ..... H01Q 11/12

(52) U.S. Cl. ..... 343/742; 343/743; 343/744; 343/745; 343/867; 340/552

(58) Field of Search ..... 343/741, 742, 343/743, 744, 745, 748, 866, 867; 340/505, 552

(56) References Cited

U.S. PATENT DOCUMENTS 2,923,813 A * 2/1960 Davis ..... 343/742
3,210,766 A * 10/1965 Parker ..... 343/742
4,745,401 A * 5/1988 Montean ..... 340/572
5,940,043 A * 8/1999 Canipe et al. ..... 343/742
5,963,173 A * 10/1999 Lian et al. ..... 343/742

* cited by examiner

*Primary Examiner*—Tho Phan
(74) *Attorney, Agent, or Firm*—Derrick Michael Reid

(57) ABSTRACT

Compensating electrical circuits are incorporated into loop antenna configurations for improved energy efficiency and extension of the magnetic fields for improved magnetic field coupling and reading of the tag by a reader. The tuning and compensating circuits provide a reader magnetic response having maxima at the center carrier frequency and at the low sideband frequency for improved reception of return signals from the tag to the reader.

12 Claims, 4 Drawing Sheets

TUNED DOUBLE LOOP ANTENNA WITH TUNING COMPENSATOR

DOUBLE LOOP ANTENNA

DOUBLE LOOP ANTENNA PATTERN

BIAXIAL DOUBLE LOOP ANTENNA

DUAL DOUBLE LOOP ANTENNA

DUAL DOUBLE LOOP ANTENNA
TRANSVERSE PATTERN

DUAL DOUBLE LOOP ANTENNA
ALIGNED PATTERN

TUNED SINGLE LOOP ANTENNA WITH TUNING COMPENSATOR

TUNED DOUBLE LOOP ANTENNA WITH TUNING COMPENSATOR

COMPENSATED LOOP FREQUENCY RESPONSE

MAGNETIC FIELD PATTERN

DOUBLE LOOP ANTENNA

REFERENCE TO RELATED APPLICATION

The present application is related to applicant's copending application entitled Loop Antenna Compensator, Ser. No. 10/022,763, filed Dec. 17, 2001, by the same inventor.

FIELD OF THE INVENTION

The invention relates to the field of antenna loops for generating coupling magnetic fields. More particularly, the present invention relates to generating strong coupling magnetic fields between a reader and tag.

BACKGROUND OF THE INVENTION

Radio frequency identification typically uses a transceiver to drive an antenna that generates a field and sends energy and data to a transponder consisting of a small printed antenna and an integrated circuit which receives the energy that turns on the transponder. The transponder then receives the data and responds by sending back data from stored memory in the transponder. In industry parlance, the transceiver is commonly called a reader and the responding circuit a transponder is commonly called a tag. An article can be tagged with a tag being disposed on the article. The return signal may include an identification of thirty-two bytes in additional to return data.

The transceiver and transponder can function at any desired frequency, but they commonly operate on an assigned frequency of 13.56 MHz. Energy available limits the range to only a few feet, which is in the near field of the antenna. The most basic and common antenna is a single turn loop antenna, tuned to resonance, and with impedance matching to a fifty ohm cable. In the near field, energy is primarily transferred by the magnetic field and the effectiveness of the antenna coupling is describe by analyzing the magnetic field in the near field. The magnetic field from reader must be sufficiently high in strength and must sufficiently extend in range to couple sufficient energy to the tag to power the tag and communicate data from the reader to the tag. The magnetic field from the tag must also be sufficient high in strength and must sufficiently extend in range to couple sufficient energy to the reader for communicating data to the reader. Hence, both the reader and tag have loop antenna for creating the respective coupling magnetic fields. The loop antennas have respective magnetic fields and antenna patterns that have respective pattern orientations which are sensitive to polarization. The pattern orientation between the reader and tag fields affects the amount of coupling, and hence affects the amount of required field strength and range.

The field of a basic loop is as follows, for a square loop, having four legs, horizontal top and bottom, and vertical left and right, described here in words for convenience. A tuning capacitor may be disposed in the top leg and a matching network in the bottom leg to which is connected an RF signal source for generating sinusoidal loop current for generating magnetic fields. By way of example, the magnetic field circles the top leg counter clockwise and circles the bottom leg clockwise, so that the magnetic lines are generated orthogonal to the plane of the loop. The antenna loop is always tuned to resonance so that maximum current exists and hence maximum magnetic filed strength. An array of multiple loops is sometimes used to additively increase the field strength for extending the range between the reader and the tag. An array of two loops is commonly used to extend the range to more than double the field of a single antenna. A common array of two antennas has a field with a strong orthogonal horizontal magnetic field produced between the two antennas.

U.S. Pat. No. 6,166,706, Gallagher, teaches two distal loop antennas with a third overlapping coupled loop used to produce a rotating magnetic field. U.S. Pat. No. , 5,103,235, Clemens, teaches a figure eight type of antenna with paired leads that are mutually coupled. The objectives described are to reduce the effects of interference and false alarms and to produce a flatter amplitude response and more linear phase versus frequency. Separate antennas are disadvantageously used for receive and transmit. Clemens teaches a conventional antenna amplitude response. U.S. Pat. No. 5,963,173, Lian, teaches adjacent double loop antenna in a figure eight configuration that is operated inphase or out of phase. Two frequencies are used to produce a field that excites a nonlinear magnetic tag. A compensating tuned loop is used to reduce detuning effects which occur when switching between the two phases. Lian teaches the use of two generator driving respective loops. U.S. Pat. No. 5,602,556, Bowers, teaches the use of various loop configurations of the antenna to produce the desired field, and a larger passive untuned loop surrounding that antenna to effectively cancel far field response as a far field canceling antenna. The canceling antenna uses separate antennas for transmit and receive without impedance compensation of the coupled loops.

One problem of these prior readers and tags is the generation of insufficient field strength over a spatial area and over a desired range from the reader to read a tag from a distal position. Another problem is tag polarization sensitivity. Typically, the tag antenna orientation is unknown. The orientation of the tag loop to the field orientation determines the amount of coupling for sufficient reading. The prior art readers and tags may not read reliably due to insufficient field strength and poor coupling due to unpredictable orientation. In some cases the tag may be stationary. Commonly, however, the tag moves through the field, such as on a conveyor belt. In these tag movement situations, different orientations may prohibit the tag from being read as the tag moves through different parts of the field generated by the reader. It is desirable in the reader to increase the signal strength and varied orientation of the magnetic fields for improved magnetic coupling and reading of the tag.

The prior readers have conventional antenna amplitude responses, as shown in Clemens, that have double peak maxima between which is a minimum. Lian teaches the use of tuning circuits to maximize reader and tag responses. Typically, a 100 pf capacitor in parallel with a 1K-ohm resister functions as a tuning circuit connected in the loop distal the transceiver in combination with a matching circuit connected proximal to the transceiver to be used for tuning single loop reader antennas. Typically, in conventional readers, the transmit carrier at 13.56 MHz is generated to power the tag that sends data. Typically, the tag modulates the carrier received and returns the desired data on upper and lower sidebands. The sidebands are approximately plus and minus 500 KHz from the carrier, and only one sideband is used. The antenna is small compared to wavelength and the radiation resistance is very low and the bandwidth is very narrow. This bandwidth is too narrow to pass the received sidebands, so a loading resistor is incorporated in the matching network to lower the Q and widen the bandwidth. This allows the received sidebands to pass, but absorbs much of the transmitted power, reducing the effective range. The tuning circuit produces a passband with good match at the transmitted carrier with return loss below 20 dB and there is a 2 dB return loss match at the sideband frequency that is adequate for the received sideband signal. The loading resistor provides a sufficiently flat band pass for receiver at the sideband signal. However, much of the transmit energy is lost in the loading resistor in the loop. The tuning resistor decreases the coupling efficiency. These and other disadvantages are solved or reduced using the invention.

SUMMARY OF THE INVENTION

An object of the invention is to provide for generation of magnetic fields for coupling between antenna loops.

Another object of the invention is to provide double loop antennas for generating coupling magnetic fields in two dimensions.

Yet another object of the invention is to provide a biaxial double loop antenna for generating coupling magnetic field in three dimensions.

Still another object of the invention is to provide tuning circuits in double loop antennas for generating coupling magnetic fields in three dimensions.

The invention is directed to a reader having a double loop antenna driven by a single transceiver that is connected between the loops of the double loop antenna. In a first aspect of the invention, the double loop antenna provides both transverse and aligned coupling magnetic fields for improved tag orientation insensitivity in two dimensions, the generating magnetic fields tending to add and cancel for generating transverse and aligned magnetic fields. In a second aspect of the invention, two double loops are disposed in parallel with one loop operated in or out of phase respecting the other so as to generate alternating transverse and aligned magnetic fields for improved tag orientation insensitivity. In a third aspect of the invention, a dual double loop antenna is use for generating transverse, aligned and orthogonal magnetic fields in all three respective dimensions for further improved tag orientation insensitivity. In a fourth aspect of the invention, a compensating circuit is used in combination with the reader loop antenna having a tuning circuit and a matching circuit for generating coupling signals that have improved coupling efficiency with reduced loop loading resistor losses. These and other advantages will become more apparent from the following detailed description of the preferred embodiments.

DETAILED DESCRIPTION OF THE PREFERRED EMBODIMENT

Figure 1A:
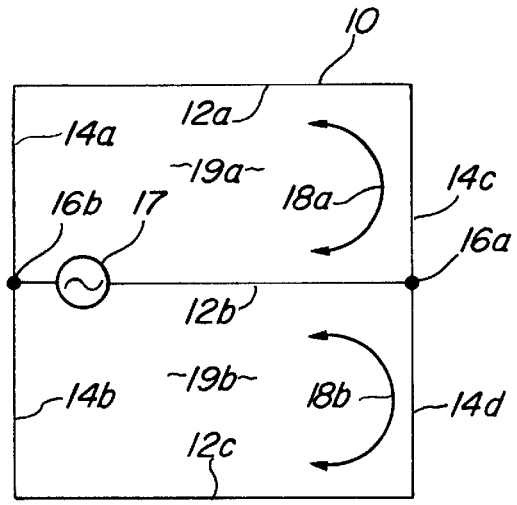
FIG. 1A is a schematic of a double loop antenna for use with a reader.
Figure 1B:
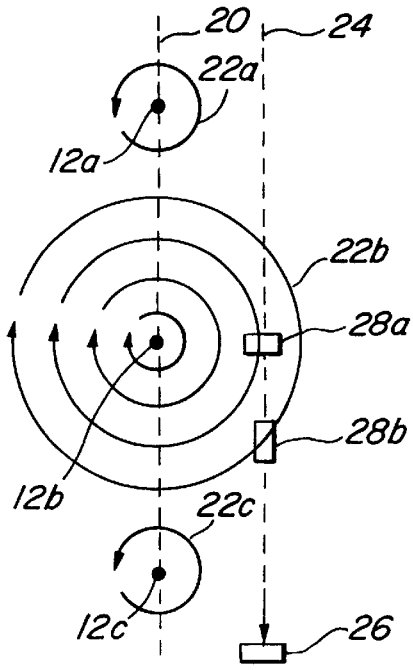
FIG. 1B is a diagram of magnetic fields extending from the double loop antenna.

An embodiment of the invention is described with reference to the figures using reference designations as shown in the figures. Referring to FIGS. 1A and 1B, a reader includes a double loop antenna 10 having two loops defined by a top horizontal leg 12*a*, a middle horizontal leg 12*b*, a bottom horizontal leg 12*c*, a left vertical top leg 14*a*, a left vertical bottom leg 14*b*, a right top leg 14*c*, and a right bottom leg 14*d*. The right vertical legs 14*c* and 14*d* connect to the middle leg 12*b* at node 16*a* and the left legs connect to the middle leg 12*b* at node 16*b*. Between the nodes 16*a* and 16*b* is transceiver 17 of the reader. The double antenna is made of two loops 19*a* and 19*b*. Loop 19*a* includes legs 12*a*, 12*b*, 14*c* and 14*a*. Loop 19*b* includes legs 12*b*, 12*c*, 14*b* and 14*d*. The transceiver 17 generates currents 18*a* and 18*b* to drive the two loops 19*a* and 19*b* with energy. The double antenna loop 10 lies in a plane 20 generating a small top counter clockwise magnetic field 22*a* about the leg 12*a*, a large center clockwise magnetic field 22*b*, and a small bottom counterclockwise magnetic field 22*c*. The large magnetic field 22*b* sufficiently extends into a path 24 along which a tag 26 moves. The tag 26 has a signal loop antenna shown in two positions. The current 18*a* generates the field 22*a*. The current 18*b* generates the field 22*c*. The currents 18*a* and 18*b* combine to generate the magnetic field 22*b*. The tag loop antennas 28*a* and 28*b* are shown as single loop antennas in respective different orientations. The tag loop antenna 28*a* is in a horizontal orientation and the tag loop antenna 28*b* is in a vertical orientation in a plane parallel to the horizontal and vertical plane of the loop 10. The tag loop antenna 28*a* is shown at a first position and is substantially exposed to vertical magnetic lines of the large magnetic field 22*b*. The tag loop antenna 28*b* is shown at a second position and is substantially exposed to horizontal magnetic lines of the large magnetic field 22*b*. As the double antenna 10 projects the large magnetic field 22*b*, the tag 26 may be in the different orientations as shown by tag loop antennas 28*a* and 28*b*. The tag 26 may be read as the tag 26 passes through the large magnetic field 22*b* with any orientation over 360° in the horizontal and vertical plane, but not in the third orthogonal direction. In operation, the loop 10 is driven by the transceiver 17 to conduct current 18*a* and 18*b* through two loops 19*a* and 19*b*.

Figure 2:
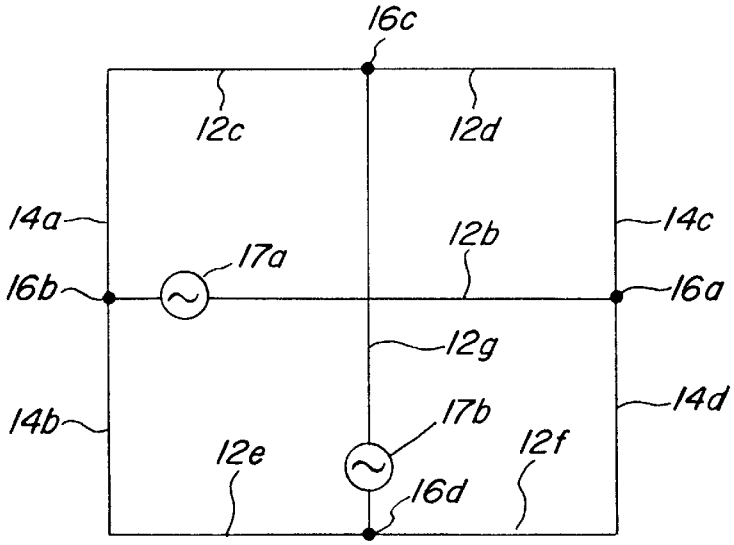
FIG. 2 is a schematic of a biaxial double loop antenna.

Referring to FIG. 2, a biaxial double loop antenna reader includes two feed points 17*a* and 17*b*. A first loop extends through legs including right vertical legs 14*c* and 14*d*, left vertical legs 14*a* and 14*b*, top legs 12*c* and 12*d*, and bottom legs 12*e* and 12*f*. The feed point 17*a* is connected to legs 14*a* and 14*b* at node 16*b* and connected to legs 14*c* and 14*d* at node 16*a* through a center leg 12*b*. A second loop also extends through right vertical legs 14*c* and 14*d*, left vertical legs 14*a* and 14*b*, top legs 12*c* and 12*d*, and bottom legs 12*e* and 12*f*. The feed point 17*b* is connected to legs 12*e* and 12*f* at node 16*d* and connected to legs 12*c* and 12*d* at node 16*c* through a center leg 12*g*. The biaxial double loop antenna design has the first double loop with feed point 17*a* in the center leg 12*b* and the second double loop with feed point 17*b* in the center leg 12*g* for providing reading in all three horizontal transverse, vertical aligned or orthogonal directions. In order to read the tag 26 in all three dimensions, the biaxial double loop antenna generates transverse, aligned and orthogonal magnetic fields in all three directions by adding the additional feed point 17*b* in leg 12*g*. The magnetic fields 22*a*, 22*b* and 22*c* that are generated by the first feed point 17*a* are also generated by the second feed point 17*b*, but in an orthogonal direction. Hence, the feed point 17*a* generates transverse and aligned magnetic fields while feed point 17*b* generates transverse and orthogonal magnetic fields. The most common problem in arrays is unwanted mutual coupling between elements of the array, which produces detuning of one antenna by another. In the biaxial design, the magnetic fields are orthogonal without field coupling. Thus, the two colocated double loop antennas may be tuned and driven independently, with no interaction. When the feed point 17*a* is activated, the primary magnetic field 28*a* is vertically aligned. When the feed point 17*b* is activated, the primary magnetic field 28*a* is orthogonal. Both the feed points, when activated generate transverse horizontal magnetic fields. With the biaxial configuration, the tag 26 passing along path 24 through the magnetic fields will be read in three dimensions.

Figure 3A:
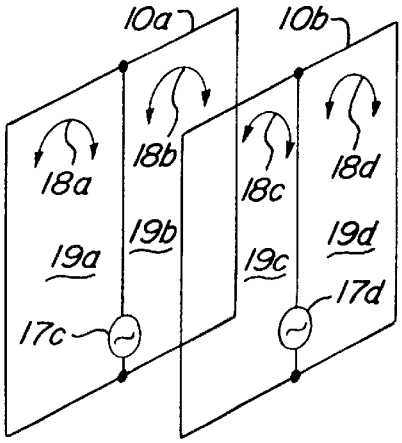
FIG. 3A is a schematic of a dual double loop antenna.
Figure 3B:
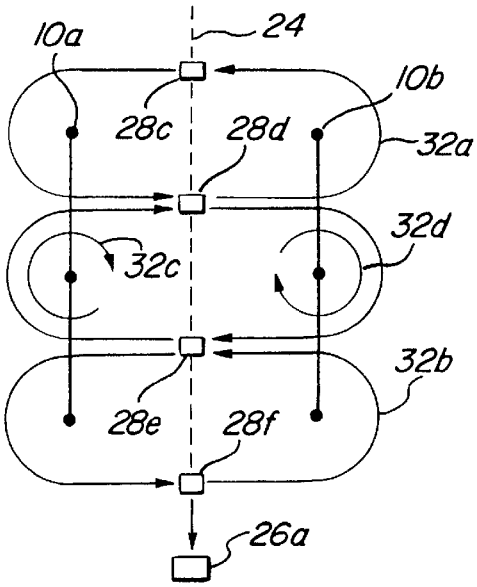
FIG. 3B is a diagram of magnetic fields extending from the dual double loop antenna when operated in phase.
Figure 3C:
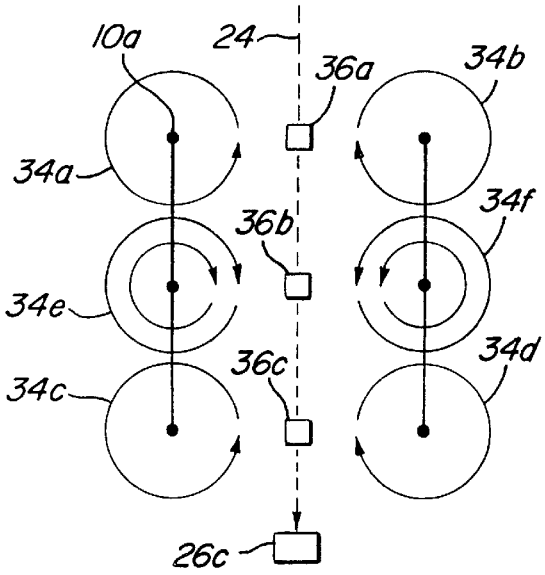
FIG. 3C is a diagram of magnetic fields extending from the dual double loop antenna when operated out of phase.

Referring to FIGS. 3A, 3B and 3C, a reader drives two feed points 17*c* and 17*d* respectively within two double-loop antennas 10*a* and 10*b*, respectively forming loops 19*a* and 19*b*, and 19*c* and 19*d*. The two double loops 10*a* and 10*b* lie in planes in parallel to each other, between which is the path 24 along which the tag 26 moves. The two double loops 10*a* and 10*b* are be respectively driven at the two feed points 17*d* and 17*c* in two different modes including an inphase mode and an outphase mode. The inphase mode is where the currents 18*a* and 18*b* of double loop 10*a* are in phase with the current 18*c* and 18*d* of double loop 10*b*. In the inphase mode, the electrical phase of the antenna loops 10*a* and 10*b* are in phase at 0°. The fields 32*a* through 32*d* add for providing a strong field transverse to the planes of the antenna loops 10*a* and 10*b*. The tag loop 28*a* through 28*f* will be read when the tag loop 28*a* through 28*f* is oriented in parallel to the planes of the antenna loops 10*a* and 10*b*. The outphase mode is where the currents 18*a* and 18*b* of double loop 10*a* are 180° out of phase with the current 18*c* and 18*d* of the double loop 10*b*. During the inphase mode, as shown in FIG. 3B, magnetic fields 32*a*, 32*b* and 32*c* are formed. The tags has a loop position shown as loops 28*c*, 28*d*, 28*e* and 28*f* as the tag 26*a* moves between the two double loops 10*a* and 10*b*, providing the low transverse magnetic field for tag loops 28*c*, a high magnetic field for loops 28*d* and 28*e* and again a low magnetic field at loop 28*f*. As the tag 26*a* moves between the fields 32*a*, 32*b* and 32*c*, the tag loops at positions 28*c*, 28*d*, 28*e* and 28*f* experience high and low transverse magnetic fields from the fields 32*a*, 32*b* and 32*c*. During the outphase mode, as shown in FIG. 3C, magnetic field 34*a* through 34*f* are formed. The double loop 10*a* generates fields 34*a*, 34*e* and 34*c* while double loop 10*b* generates fields 34*b*, 34*f* and 34*d*. As the tag 26*b* moves through the positions shown as 36*a*, 36*b*, 36*c*, it moves along path 24 between the double loops 10*a* and 10*b*. The tag 26*b* has a position shown as loops 36*a*, 36*b*, 36*c* representing the tag 26*b* as the tag 26*b* moves between the two double loops 10*a* and 10*b*, providing the low aligned magnetic field for tag position 36*a*, a high aligned magnetic field for position 36*b* and again a low aligned magnetic field at loop 36*c*. As the tag 26*b* moves between the fields 34*a* and 34*b*, 34*e* and 34*f*, and 34*c* and 34*d*, the tag positions 36*a*, 36*b* and 36*c* experience low and high aligned magnetic fields. Hence, as the two double loops 10*a* and 10*b* are switched between the inphase and outphase mode, the tag 26*a* and 26*b* experiences alternating transverse and aligned magnetic fields. The alternating magnetic fields provide magnetic coupling in two direction about tag 26*a* and 26*b* for reading in the horizontal and vertical plane, but not in the orthogonal direction. The dual double loop reader provides an ability to alternate magnetic fields patterns extending from the loops 10*a* and 10*b*. When the double loops 10*a* and 10*b* are driven inphase, a strong field is produced that traverses across the space between the antenna loops 10*a* and 10*b*. When the double loops 10*a* and 10*b* are driven outphase, a strong field is produced that aligns within the space between the antennas loops 10*a* and 10*b*. In the outphase mode, the electrical phase of one of the antenna loops 10*a* and 10*b* is reversed by 180° degrees. The fields 34*a* through 34*d* add for providing a strong field in parallel to the planes of the antenna loops 10*a* and 10*b*. The tag 26*a* and 26*b* will be read when the tag positions 36*a*, 36*b* and 36*c* are oriented at 90° degrees to the planes of the antennas 10*a* and 10*b*. in the inphase mode, a tag 26*a* and 26*b* passing between the loops 10*a* and 10*b* will experience magnetic coupling for reading when the tag 26*a* and 26*b* is parallel to the plane of the antenna loops 10*a* and 10*b*.

In the outphase mode, the electrical phase of one of the antenna loops 10*a* and 10*b* is reversed by 180° degrees. The fields 34*a* through 34*d* add for providing a strong field in parallel to the planes of the antenna loops 10*a* and 10*b*. The tag 26*a* and 26*b* will be read when the tag at positions 36*a*, 36*b* and 36*c* are oriented at 90° degrees to the planes of the antennas 10*a* and 10*b*. The signal to the feed points 17*c* and 17*d* provides phase switching to rapidly reverse the phase of one of the antenna loops 10*a* or 10*b* respecting the other. Thus, a tag 26*a* or 26*c* will be read in any two dimensional orientation as the tag 26*a* or 26*c* passes through the fields between the double loops 10*a* and 10*b*. For example, a multiplexer switch, not shown, driving the feed point 17*d* alternates phase on the antenna loop 10*b*, for alternately providing reading in two axes with alternating strong fields.

Figure 4:
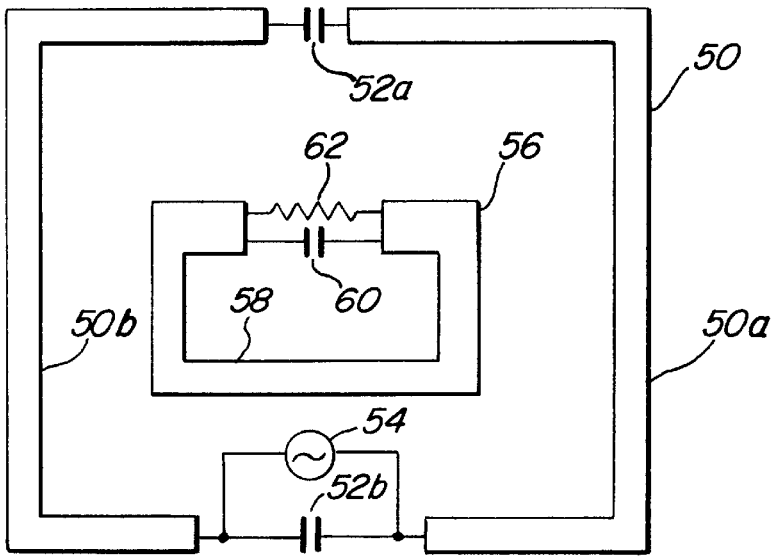
FIG. 4 is a schematic of a tuned single loop antenna with tuning compensator.

Referring to FIG. 4, a tuned single loop antenna reader has a loop 50 made of right leg 50*a* and left leg 50*b* that may be made of 1.5 inch copper foil forming a twenty-four inch square loop 50. Between the legs 50*a* and 50*b* is disposed a 100 pf tuning capacitor 52*a* and a 500 pf matching capacitor 52*b* across which is connected the transceiver generator 54. Disposed in the center of the plane of the loop 50 is a compensating circuit 56 having 0.5 inch wide copper foil loop 58 in which is connected in parallel a 1000 pf compensating capacitor 60 and a 750 ohm compensating resistor 62. The matching capacitor 52*b* functions as a matching network for providing a fifty ohm impedance at the feed point of the loop 50. The transceiver 54 may be connected by way of coaxial cable having a fifty ohm matching impedance for efficient transfer of power from the generator 54 to the loop 50.

Figure 5:
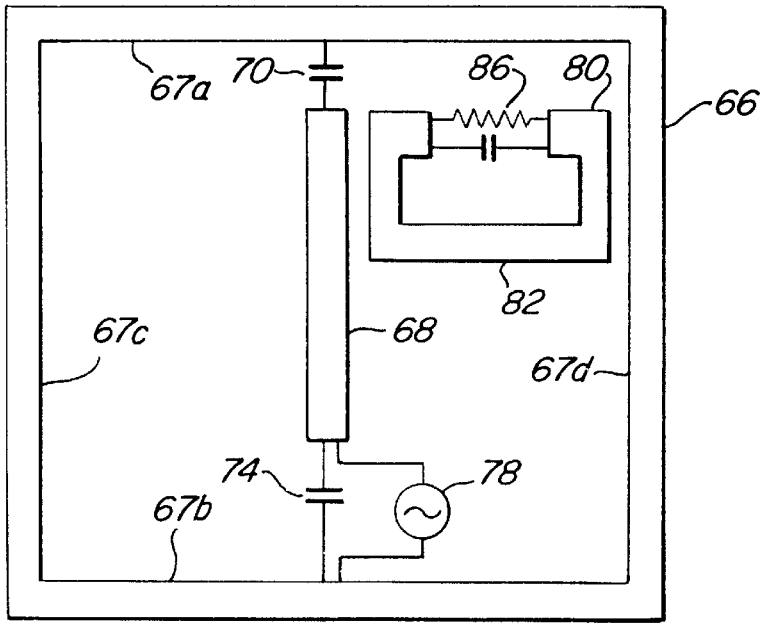
FIG. 5 is a schematic of a tuned double loop antenna with tuning compensator.
Figure 6:
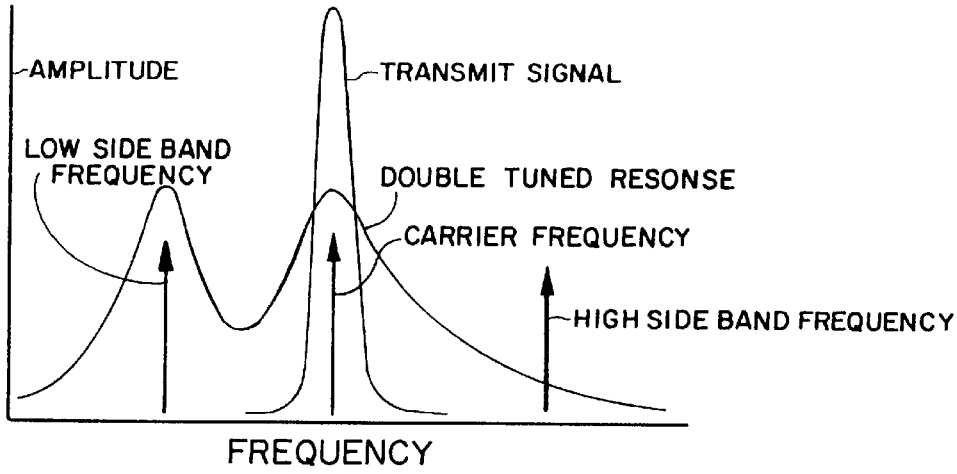
FIG. 6 is a graph of a compensated loop antenna frequency response.
Figure 7:
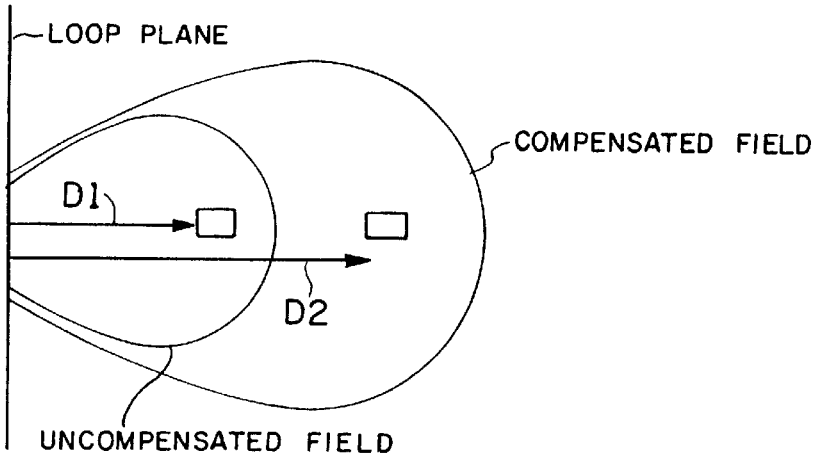
FIG. 7 is a diagram of magnetic field pattern.

Referring to FIG. 5, a tuned double loop antenna reader includes an outer loop 66 having an upper leg 67*a*, a lower leg 67*b*, a left leg 67*c* and a right leg 67*d*, all surrounding a center leg 68. The loop 66 and center leg 68 are preferably made of 1.5 inch cooper foil and may, for example, form a loop thirty inches square. A 200 pf tuning capacitor 70 is disposed between the upper leg 67*a* and the center leg 68. A matching capacitor 74 is disposed between the center leg 68 and the lower leg 67*b*. The matching capacitor 74 forms a matching circuit across which is connected the transceiver generator 78. In the plane of the loop 66 is disposed a compensating circuit 80 having a compensating loop 82 in which is disposed a 1000 pf resonant tuning capacitor 84 and a 750 ohm loading resistor 86. The tuned double loop antenna can be made into a tuned biaxial double loop antenna with the addition of another center leg 68, tuning capacitor 70, matching capacitor 74, and transceiver generator 78 connected horizontally between legs 67*c* and 67*d*.

Referring to FIGS. 4, 5, 6 and 7, the single loop 50 and double loop 66 operate without loading resistance and use the compensating loop to provide good matching at the received sideband frequency. The loops 50 and 66 use this double tuned resonant technique for improved impedance matching and coupling efficiency. The equivalent circuits of loops 50 and 66 have responses depending on the component values selected for the compensating loops, without using loading resistance on the primary antenna loops 50 and 66, resulting in improved transmitted signal at the carrier frequency of the transmitted signal, and for improved matching to the low side band frequency for maximum received signals at the carrier frequency and low side band frequency. The improved transmitter efficiency and receiving of signals at the low side band frequency and the center carrier frequency increases the reading range from a distance D1 for an uncompensated loop to a distance D2 for a compensated loop, while also widening the effective pattern of the compensated loop.

The compensating loop circuits 56 and 80 operate in combination with the tuning components to produce a desired over coupled and double tuned response where energy of the received signal about the low side frequency and center carrier frequency are received. The transmitting gain of the antenna loop with the compensating loop tuning provides a double maxima response for increased efficiency at the transmit frequency and increased received signal energy at the center carrier frequency and also at the low sideband frequency for improved energy return efficiency. The resonant currents in the compensating loops 58 and 82 force more of the magnetic fields towards the outside of the antenna loops 50 and 66 in a double maxima frequency response of the received signals for a wider pattern and increased distance of effective magnetic signal coupling. The magnetic fields of the compensated loop 50 and 66 have wider and longer magnetic fields for improved magnetic coupling and reading of the tag.

The transceivers may be, for example, TI-6000 readers operating with conventional TI tags. Those skilled in the art can make enhancements, improvements, and modifications to the invention, and these enhancements, improvements, and modifications may nonetheless fall within the spirit and scope of the following claims.

What is claimed is:

1. A double loop antenna driven by a transceiver for generating magnetic fields extending from the antenna for coupling power to a loop antenna of a tag, the double antenna loop comprising, an outer loop which may be square lying in a plane having a top leg, a bottom leg, a right leg and a left leg, and a center leg connected between the top leg and the bottom leg forming a first loop and a second loop, the first loop comprising the left leg, the center leg, a left half of the top leg, and a left half of the bottom leg, the second loop comprising the right leg, the center leg, a right half of the top leg and a right half of the bottom leg, the center leg connected to the transceiver for generating currents through first and second loops for generating transverse and aligned magnetic fields with the tag loop coupling to the transverse and aligned magnetic fields for receiving power from the transceiver.

2. The double antenna loop of claim 1 wherein, the outer loop and center leg comprising conductive foil lying in the plane.

3. The double loop antenna of claim 1 further comprising, a tuning circuit disposed between the center leg and the top leg, and a matching circuit disposed between the center leg and the bottom leg, the matching and tuning circuits being used to facilitate the generation of the magnetic field pattern of the transverse and aligned magnetic fields.

4. The double antenna loop of claim 1 further comprising, a compensating circuit lying in the plane for defining a frequency response for efficiently transmitting to and receiving of magnetic signals from the loop antenna of the tag for reading the tag.

5. A dual double loop antenna driven by a reader having a first and a second feed point for generating magnetic fields extending from the reader for coupling power to the loop antenna of a tag, the double loop antenna comprising, a first outer loop which may be square lying in a first plane having a first top leg, a first bottom leg, a first right leg and a first left leg, a first center leg connected between the first top leg and the first bottom leg forming a first loop and a second loop, the first loop comprising the first left leg, the center leg, a first left half of the first top leg, and a first left half of the first bottom leg, the second loop comprising the first right leg, the first center leg, a first right half of the first top leg and a first right half of the first bottom leg, the first center leg connected to the first feed point for generating currents through the first and second loops for generating first transverse and first aligned magnetic fields through the tag loop coupling the first transverse and first aligned magnetic fields for receiving power from the first feed point, a second outer loop which may be square lying in a second plane parallel to the first plane, the second outer loop having a second top leg, a second bottom leg, a second right leg and a second left leg, and a second center leg connected between the top leg and the bottom leg forming a third loop and a fourth loop, the third loop comprising the second left leg, the second center leg, a second left half of the second top leg, and a second left half of the second bottom leg, the fourth loop comprising the second right leg, the second center leg, a second right half of the second top leg and a second right half of the second bottom leg, the second center leg connected to the second feed point for generating currents through third and fourth loops for generating second transverse and second aligned magnetic fields through the tag loop antenna coupling the second transverse and second aligned magnetic fields for receiving power from the second feed point.

6. The dual double loop of claim 5 wherein, the first outer loop and first center leg comprise conductive foil lying in the first plane, and the second outer loop and second center leg comprise conductive foil lying in the second plane.

7. The double loop antenna of claim 5 further comprising, a first tuning circuit disposed between the first center leg and the first top leg, a first matching circuit disposed between the first center leg and the first bottom leg, the first tuning and first matching circuits defining a first magnetic pattern of the first transverse and first aligned magnetic fields, a second tuning circuit disposed between the second center leg and the second top leg, and a second matching circuit disposed between the second center leg and the second bottom leg, the second tuning and second matching circuits defining a second magnetic pattern of the second transverse and second aligned magnetic fields.

8. The double loop antenna of claim 5 further comprising, a first compensating circuit lying in the first plane for defining a first frequency response for more efficient receiving and transmitting of magnetic signals from the loop antenna of the tag, and a second compensating circuit lying in the second plane for defining a second frequency response for more efficient receiving and transmitting of magnetic signals from the loop antenna of the tag for reading the tag.

9. A biaxial double loop antenna loop driven by a reader having a first feed point and a second feed point for generating magnetic fields extending from the reader for coupling power to the loop antenna of a tag, the biaxial double loop antenna comprising, an outer loop which may be square lying in a plane having a top leg, a bottom leg, a right leg and a left leg, a first center leg connected between the top leg and the bottom leg forming a first loop and a second loop, the first loop comprising the left leg, the first center leg, a first left half of the top leg, and a first left half of the first bottom leg, the second loop comprising the first right leg, the first center leg, a first right half of the first top leg and a first right half of the first bottom leg, the first center leg connected to the first feed point for generating currents through the first and second loops for generating first transverse and first aligned magnetic fields through the tag loop antenna coupling the first transverse and first aligned magnetic fields for transmitting and receiving power from the first feed point, and a second center leg connected between the right leg and the left leg forming a third loop and a fourth loop, the third loop comprising a left half of the top leg, the second center leg, a left half of the bottom leg, and the left leg, the fourth loop comprising the right leg, the second center leg, a right half of the top leg and a right half of the bottom leg, the second center leg connected to the second feed point for generating currents through third and fourth loops for generating orthogonal magnetic fields through the tag loop antenna coupling the orthogonal magnetic fields for transmitting and receiving power from the second feed point.

10. The biaxial double loop antenna of claim 9 wherein, the outer loop and first and second center legs comprise conductive foil lying in the plane.

11. The biaxial double loop antenna of claim 9 further comprising, a first tuning circuit disposed between the first center leg and the first top leg, a first matching circuit disposed between the first center leg and the first bottom leg, the first tuning and first matching circuits defining a first magnetic pattern of the first transverse and first aligned magnetic fields, a second tuning circuit disposed between the second center leg and the second top leg, and a second matching circuit disposed between the second center leg and the second bottom leg, the second tuning and second matching circuits defining a second magnetic pattern of an orthogonal magnetic field.

12. The biaxial double loop antenna of claim 9 further comprising, a compensating circuit lying in the plane for defining a frequency response for more efficient transmitting and receiving of magnetic signals from the loop antenna of the tag for reading the tag.

* * * * *